US012006951B2

(12) United States Patent
Büche et al.

(10) Patent No.: US 12,006,951 B2
(45) Date of Patent: Jun. 11, 2024

(54) TURBO-MACHINE ARRANGEMENT

(71) Applicant: MAN Energy Solutions SE, Augsburg (DE)

(72) Inventors: Dirk Büche, Wutöschingen (DE); Janine Sutter, Gebenstorf (CH)

(73) Assignee: MAN ENERGY SOLUTIONS SE, Augsburg (DE)

( * ) Notice: Subject to any disclaimer, the term of this patent is extended or adjusted under 35 U.S.C. 154(b) by 135 days.

(21) Appl. No.: 17/861,748

(22) Filed: Jul. 11, 2022

(65) Prior Publication Data

US 2023/0018652 A1 Jan. 19, 2023

(30) Foreign Application Priority Data

Jul. 14, 2021 (DE) ..... 10 2021 118 253.0

(51) Int. Cl.
*F04D 29/58* (2006.01)
*F04D 25/06* (2006.01)

(52) U.S. Cl.
CPC ..... *F04D 29/5806* (2013.01); *F04D 25/06* (2013.01); *F04D 29/5826* (2013.01); *F04D 29/5846* (2013.01)

(58) Field of Classification Search
CPC .... F04D 17/12; F04D 17/122; F04D 29/5806; F04D 29/5826; F04D 29/5846
See application file for complete search history.

(56) References Cited

U.S. PATENT DOCUMENTS

2016/0040915 A1* 2/2016 Jonsson ..... F04D 25/06 417/423.12
2020/0340495 A1 10/2020 Creomar Lima Junior et al.

FOREIGN PATENT DOCUMENTS

| | | | |
|---|---|---|---|
| DE | 69205534 | 3/1996 | |
| DE | 102007019264 | 11/2008 | |
| DE | 102007019264 A1 * | 11/2008 | ..... F04D 29/162 |
| DE | 102009026329 | 3/2010 | |
| DE | 102015107002 | 11/2015 | |
| EP | 1074746 | 5/2005 | |
| WO | WO 2013139568 | 9/2013 | |

OTHER PUBLICATIONS

Search Report dated Dec. 8, 2022 issued in European Patent Application No. 22183529.1.
Office Action dated Jan. 27, 2023 issued in India Patent Application No. 202244039976.
Office Action of corresponding German Patent Application No. 10 2021 118 253.0.

* cited by examiner

*Primary Examiner* — Kenneth J Hansen
(74) *Attorney, Agent, or Firm* — Cozen O'Connor

(57) ABSTRACT

A turbo-machine arrangement having a compressor section comprising a compressor shaft, an electric machine having a shaft, the compressor shaft is coaxial to the shaft. The compressor shaft is coupled to the electric machine shaft. The electric machine and compressor section are arranged in a common housing and mounted via bearings. The housing having a supply line via which uncompressed working medium is supplied, a discharge line, via which compressed working medium is discharged, and an ejector, supplied via a first connection with working medium at a first pressure level for drawing in working medium at a lower second pressure level via a second connection. A mixture formed in the ejector is supplied to the electric machine and/or another assembly to be cooled via a third connection.

10 Claims, 4 Drawing Sheets

TURBO-MACHINE ARRANGEMENT

BACKGROUND OF INVENTION

1. Field of the Invention

The disclosure relates to a turbo-machine arrangement.

2. Description of Related Art

A turbo-machine arrangement having at least one single-stage or multi-stage compressor section and an electric machine driving the or each compressor section is also referred to as integrated motor-compressor.

From WO 2013/139568 A1 a turbo-machine arrangement having a multi-stage compressor section and an electric machine is known, wherein the electric machine drives the compressor section for increasing a pressure of a working medium. A compressor shaft of the compressor section runs co-axially to a shaft of the electric machine and is coupled to the shaft of the electric machine. The electric machine and the compressor section are arranged in a common housing and mounted in the housing via bearings. Compressed working medium can be extracted as cooling gas from a stage of the compressor section, which can be utilised for cooling the electric machine.

From EP 1 074 746 B1 a turbo-compressor having multiple compressor sections is known. The compressor sections and the electric machine, which drives the compressor sections, are arranged in a gas-tight housing and mounted in the housing via bearings. The shaft of the respective compressor section and the shaft of the electric machine run co-axially to one another and are coupled without gearing. Compressed working medium, which is branched off from a compressor section, serves for cooling the electric machine.

DE 10 2007 019 264 A1 discloses a further turbo-compressor. It is disclosed to extract working medium compressed in the region of a compressor stage of a compressor section of the turbo-compressor, conduct the same via a wheel side chamber end, emanating from the wheel side chamber, conduct the same via an extraction channel into a collection chamber in order to provide this working medium to an assembly to be cooled.

SUMMARY OF THE INVENTION

In particular, when working medium compressed in the region of a compressor section is extracted and used for cooling assemblies of a turbo-machine arrangement, there is the disadvantage of a reduced overall efficiency of the turbo-machine arrangement. In addition to this, compressed working medium is already heated as a consequence of the compression, as a result of which the cooling power is reduced.

There is a need for a more efficient cooling of an electric machine of a turbo-machine arrangement with high thermodynamic overall efficiency of the turbo-machine arrangement.

Starting out from this, one aspect of the present invention is creating a new type of turbo-machine arrangement.

The turbo-machine arrangement is equipped with at least one single or multi-stage compressor section each for increasing the pressure of a working medium such as a process gas, wherein the respective compressor section comprises a compressor shaft. Further, the turbo-machine arrangement is equipped with an electric machine comprising a shaft. The compressor shaft of the respective compressor section runs co-axially to the shaft of the electric machine.

The compressor shaft of the respective compressor section is preferentially coupled directly and without gearing to the shaft of the electric machine.

The electric machine and the respective compressor section are arranged in a common hermetically sealed single or multi-part housing and via bearings mounted in the housing in such a manner that the respective compressor section, the electric machine and the bearings are altogether washed about by the working medium. Uncompressed working medium can be supplied to the turbo-machine arrangement via a supply line. Compressed working medium can be discharged from the turbo-machine arrangement via a discharge line.

Furthermore, the turbo-machine arrangement according to one aspect of the invention is equipped with at least one ejector, which via a first line or a first connection can be supplied as propellant with a working medium at a first pressure level, namely for sucking in working medium at a lower second pressure level via a second line or a second connection, wherein a mixture formed in the at least one ejector of the working medium at the first pressure level and the working medium at the second pressure level can be supplied as cooling medium to the electric machine and/or to at least one other assembly to be cooled, in particular to the bearings via a third line or a third connection.

With aspects of the invention present here it is proposed that the turbo-machine arrangement comprises the at least one ejector, which as propellant can be supplied with the working medium at the first pressure level, which preferentially is at least partly-compressed working medium, in order to draw in, via the pressure differential between the working medium at the first pressure level and the working medium at the lower second pressure level, which is preferentially uncompressed working medium, the working medium at the lower second pressure level, to mix the same with the working medium at the first pressure level and then supply this mixture to the electric machine and/or to the at least one other assembly to be cooled for cooling.

Since only a part of the cooling medium conducted through or via the electric machine and/or the at least one other assembly to be cooled consists of the working medium at the first pressure level, preferentially of at least partially compressed working medium, and the other part of the working medium at the lower second pressure level, preferentially of uncompressed working medium, the cooling medium on the one hand has a lower temperature while on the other hand the thermodynamic overall efficiency of the turbo-machine arrangement can thereby be increased. A more efficient cooling of the electric machine with high thermodynamic overall efficiency of the turbo-machine arrangement can be provided.

Preferentially, the at least one ejector is coupled via the first line or the first connection to the compressor section or one of the compressor sections or to the discharge line of the turbo-machine arrangement or to a first leakage point of the turbo-machine arrangement. Preferentially, the at least one ejector is coupled via the second line or the second connection to the supply line of the turbo-machine arrangement or to a second leakage point of the turbo-machine arrangement or a return line of the turbo-machine arrangement for cooling medium conducted via or through the electric machine and/or the at least one other assembly to be cooled.

According to one aspect of the invention, a return line for the cooling medium conducted via or through the electric machine and/or the at least one other assembly to be cooled is coupled to the supply line of the turbo-machine arrangement in such a manner that an opening point of the return line of the cooling medium into the supply line of the turbo-machine arrangement, seen in the through-flow direction of the supply line of the turbo-machine arrangement, lies downstream of a branch-off point of the second line or of the second connection of the supply line of the turbo-machine arrangement. The branch-off point of the second line or of the second connection serves for extracting the working medium at a lesser or lower pressure, which is supplied to the at least one ejector.

This first further development of the invention is particularly preferred. In that the opening point of the return line into the supply line lies downstream of the branch-off point of the second line or of the second connection of the supply line it is ensured that, via the second line or the second connection, exclusively uncompressed cold working medium is sucked in via the ejector, which does not contain any returned cooling medium.

According to one aspect of the invention, the return line for the cooling medium conducted through or via the electric machine and/or the at least one other assembly to be cooled is coupled to the second line leading to the at least one ejector or the second connection of the ejector for feeding the propellant into the at least one ejector. By way of this second further development, a closed cooling circuit for the cooling medium conducted via the electric machine can be provided.

Preferentially, a heat exchanger or cooler is integrated in the respective return line for the cooling medium for increasing the efficiency. The integration of the heat exchanger in the return line for the cooling medium is particularly preferred for an efficient cooling of the electric machine and/or of the at least one other assembly to be cooled.

Preferentially, for further increasing the efficiency, the at least one ejector is coupled via the first line or the first connection to the compressor section or one of the compressor sections, wherein the at least one ejector is coupled via the second line or the second connection to the supply line of the turbo-machine arrangement. This coupling of ejector to the compressor section and to the supply line of the turbo-machine arrangement is particularly preferred in order to provide an efficient cooling of the electric machine and/or of the at least one other assembly to be cooled such as the bearings at a high thermodynamic overall efficiency of the turbo-machine arrangement.

BRIEF DESCRIPTION OF THE DRAWINGS

Exemplary embodiments of the invention are explained in more detail by way of the drawing without being restricted to this. There it shows.

DETAILED DESCRIPTION OF THE PRESENTLY PREFERRED EMBODIMENTS

The invention introduced here relates to a turbo-machine arrangement 10 embodied in particular as an integrated motor-compressor.

Figure 1:
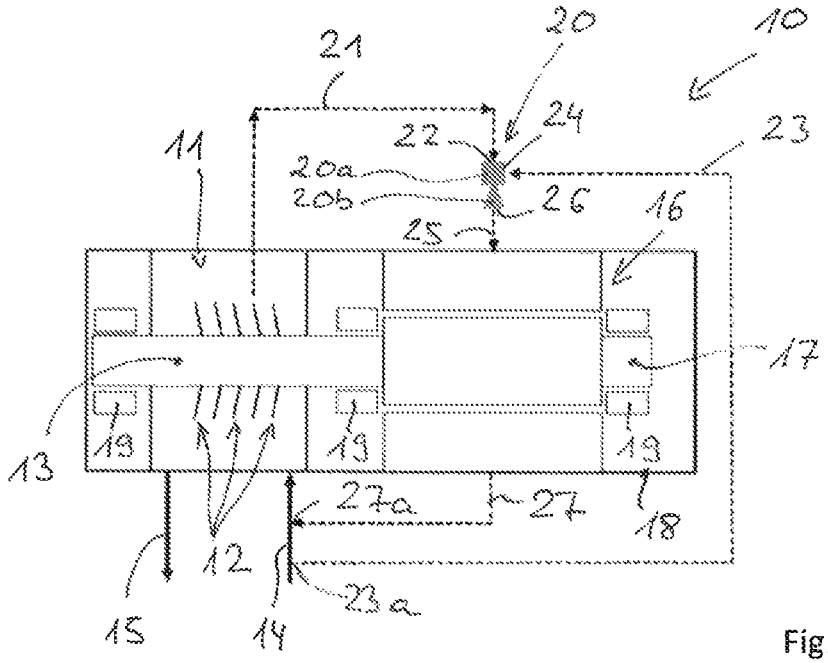
FIG. 1 is a schematised representation of a turbo-machine arrangement.

FIG. 1 shows a turbo-machine arrangement 10 according to one aspect of the invention formed as integrated motor-compressor, which comprises a compressor section 11 for increasing the pressure of a working medium, preferentially for compressing a process gas. The compressor section 11 in FIG. 1 is equipped with multiple compressor stages 12 and with a compressor shaft 13, wherein the compressor section 11 and thus the turbo-machine arrangement 10 can be supplied with uncompressed working medium via a supply line 14 of the turbo-machine arrangement 10, and wherein from the compressor section 11 and thus from the turbo-machine arrangement 10, compressed working medium can be discharged via a discharge line 15 of the turbo-machine arrangement 10. The turbo-machine arrangement 10 of FIG. 1 formed as integrated motor-compressor is equipped furthermore with an electric machine 16 having a shaft 17, wherein the electric machine 16 serves for driving the compressor section 11. The compressor shaft 13 and the shaft 17 of the electric machine 16 run co-axially to one another. Further, the compressor shaft 13 and the shaft 17 of the electric machine 16 are preferentially coupled to one another directly and without gearing.

The electric machine 16 and the compressor section 11 are arranged in a common hermetically sealed and thus gas-tight housing 18 and rotatably mounted in the housing 18 via bearings 19. The gas-tight housing 18 can be formed integrally or in multiple parts. Here, the compressor section 11, the electric machine 16 and the bearings 19 are altogether washed about by the working medium, in particular the process gas.

The turbo-machine arrangement 10 according to one aspect of the invention is equipped with at least one ejector 20. The ejector 20 shown in FIG. 1 can be supplied via a first line 21 or a first connection 22 with working medium at a first pressure level as propellant, namely for drawing in a working medium at a lower second pressure level via a second line 23 or a second connection 24, wherein a mixture of the working medium at the first pressure level and the working medium at the second pressure level formed in the ejector 20 can be supplied as cooling medium to the electric machine 16 and/or to at least one other assembly to be cooled such as the bearings 19 via a third line 25 or a third connection 26.

In FIG. 1, the ejector 20 can be supplied via the first line 21 or the first connection 22 with at least partially compressed working medium as propellant for drawing in uncompressed working medium via the second line 23 or the second connection 24, wherein the mixture of the at least partially compressed working medium and of the uncompressed working medium formed in the ejector 20 can be supplied as cooling medium to the electric machine 16 and/or to the at least one other assembly to be cooled such as the bearings 19 via the third line 25 or the third connection 26.

Here, the ejector 20 is equipped with a mixing chamber 20*a* and a diffuser 20*b*, wherein the mixing chamber 20*a* provides the first connection 22 and the second connection 24 and the diffuser 20*b* the third connection 26. The partially compressed working medium conducted via the connection 22 generates as propellant via a preferentially adjustable drive nozzle a pulsed jet of the working medium, which enters the mixing chamber 20*a*. The ejector 20 can be supplied, via the first connection 22 of the mixing chamber 20*a*, emanating from the compressor section 11, via the first line 21, at least partially compressed working medium which in FIG. 1 corresponds to the working medium at the first pressure level, wherein in FIG. 1 the partially compressed working medium is branched off from the compressor section 11 and conducted to the ejector 20.

In that the partially compressed working medium, which is conducted via the first line 21 or the first connection 22 into the ejector 20, has a higher pressure than the uncompressed working medium, which in FIG. 1 corresponds to the working medium at the lower second pressure level, is conducted via the second line 23 or the second connection 24 into the ejector 20, uncompressed working medium can be drawn in as a consequence of this pressure differential via the preferentially adjustable drive nozzle in the mixing chamber 20*b* of the ejector 20 emanating from the supply line 14 of the turbo-machine arrangement 10 via the second line 23 or the second connection 24, which uncompressed medium is mixed with the at least partially compressed working medium in the region of the mixing chamber 20*a*.

This mixture of the at least partially compressed working medium or the working medium at the first pressure level and the uncompressed working medium or the working medium at the second pressure level is provided via the diffuser 20*b* of the ejector 20 and the third connection 26 provided by the diffuser 20*b* as well as via the third line 25 to the electric machine 16 and/or to the at least one other assembly to be cooled such as the bearings 19 for cooling.

The mixing ratio of partially compressed working medium, which in FIG. 1 corresponds to the working medium at the first pressure level, and uncompressed working medium, which in FIG. 1 corresponds to the working medium at the second pressure level, is on the on hand dependent on the design of the ejector and on the other hand on the pressure differential between the uncompressed working medium or the working medium at the second pressure level and the partially compressed working medium or the working medium at the first pressure level, wherein the portion of uncompressed working medium or of working medium at the second pressure level, which is drawn in via the second line 23, is the greater the higher the pressure differential is between the at least partially compressed working medium or the working medium at the first pressure level and the uncompressed working medium or the working medium at the second pressure level.

Owing to the fact that in FIG. 1 for cooling the electric machine 16 and/or the at least one other assembly to be cooled such as the bearings 19, the mixture of at least partially compressed working medium and uncompressed working medium is conducted via the electric machine 16 and/or the at least one other assembly to be cooled such as the bearings 19, the cooling medium has a lower temperature than in the prior art, in which merely at least partially compressed working medium is branched-off from the compressor section 11 and conducted via the electric machine 16 for cooling. By way of this, the cooling power can be improved while, further, an improved thermodynamic overall efficiency of the turbo-machine arrangement 10 is provided.

In FIG. 1, the ejector 20, namely the mixing chamber 20*a* of the same, is accordingly coupled via the first line 21 or the first connection 22 to the compressor section 11, namely a compressor stage 12 of the same. Further, the ejector 20, namely the mixing chamber 20*a* of the same is coupled in FIG. 1 via the second line 23 or the second connection 24 to the supply line 14 of the turbo-machine arrangement 10. In addition to this, the ejector 20, namely the diffuser 20*b* of the same, is coupled via the third line 25 or the third connection 26 to the electric machine 16.

In FIG. 1, the electric machine 16 is coupled via a return line 27 for the cooling medium conducted via the electric machine 16 to the supply line 14 of the turbo-machine arrangement 10, namely in such a manner that an opening point 27*a* of the return line 27 into the supply line 14 of the turbo-machine arrangement 10, seen in the through-flow direction of the supply line 14 of the turbo-machine arrangement 10, lies downstream of a branch-off point 23*a* of the second line 23 of the supply line 14. By way of this it is ensured that via the second line 23 merely fresh working medium is extracted with the line 23.

Figure 2:
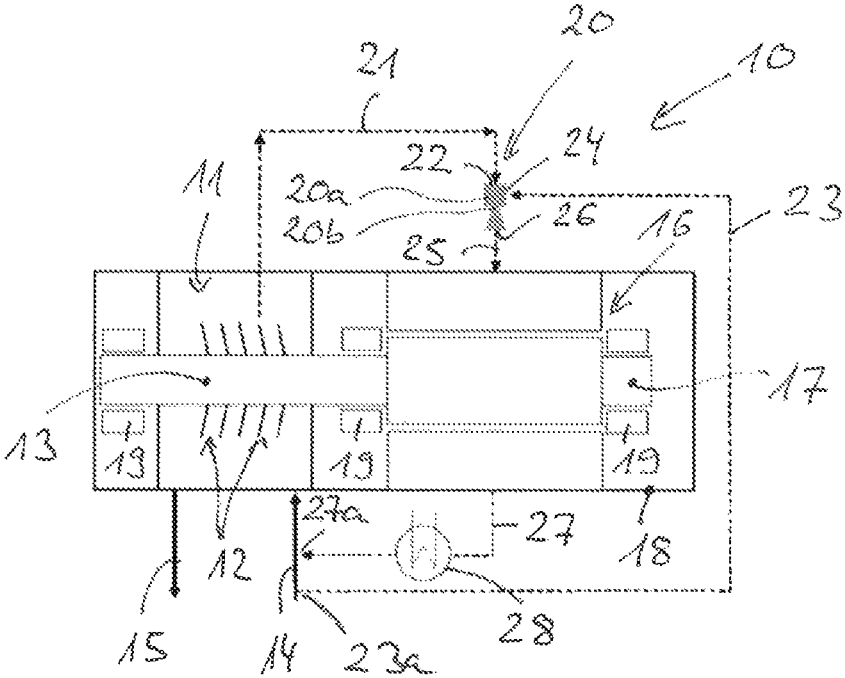
FIG. 2 is a schematised representation of a turbo-machine arrangement.

FIG. 2 shows a further development of the turbo-machine arrangement 10 of FIG. 1, wherein the turbo-machine arrangement 10 of FIG. 2 differs from the turbo-machine arrangement 10 of FIG. 1 merely in that in the return line 27 a heat exchanger 28 or cooler is integrated in order to cool the cooling medium before the return into the supply line 14 of the turbo-machine arrangement 10. This also serves for increasing the thermodynamic overall efficiency. Otherwise, the turbo-machine arrangement 10 of FIG. 2 corresponds to the turbo-machine arrangement 10 of FIG. 1, which is why for avoiding unnecessary repetitions, same reference numbers are used for same assemblies and reference is made to the explanations regarding the turbo-machine arrangement 10 of FIG. 1.

Figure 3:
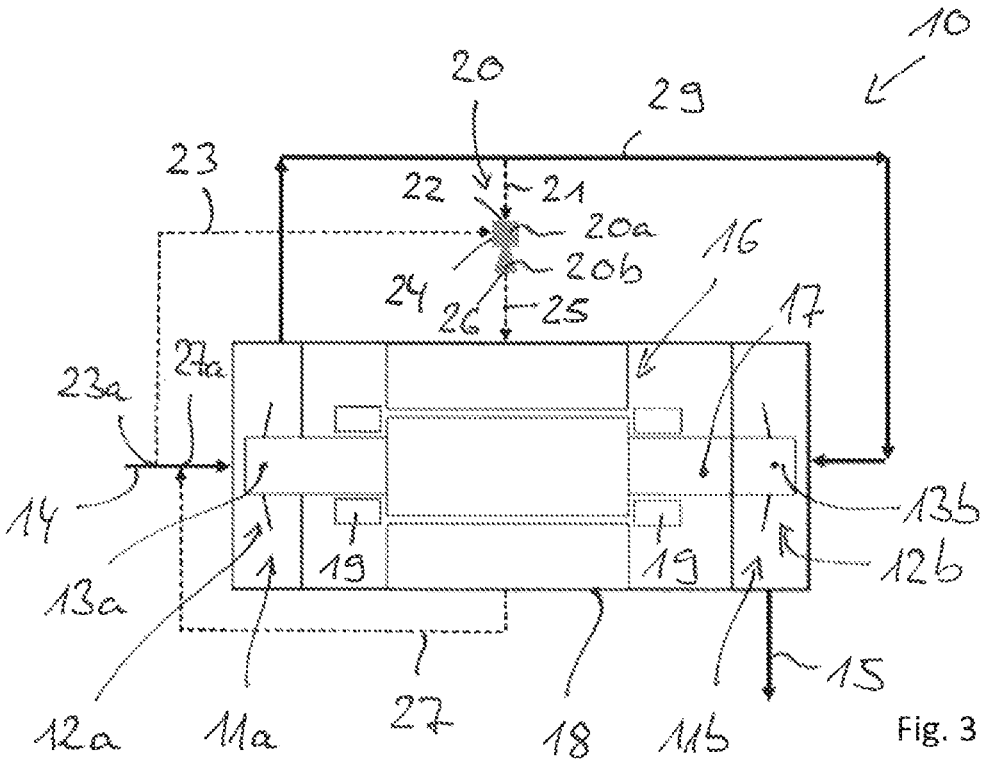
FIG. 3 is a schematised representation of a turbo-machine arrangement.

FIG. 3 shows a modification of the turbo-machine arrangement 10 of FIG. 1 which differs from FIG. 1 in that in the turbo-machine arrangement 10 of FIG. 3 two compressor sections 11*a*, 11*b* are present, which are each equipped with a compressor stage 12*a*, 12*b* and a compressor shaft 13*a*, 13*b*, wherein these compressor sections 11*a*, 11*b* are arranged on sides of the electric machine 16 located opposite one another. Both compressor shafts 13*a*, 13*b* are each preferentially coupled, on different sides of the electric machine 16 located opposite one another, preferentially directly and without gearing to the shaft 17 of the electric machine 16.

In FIG. 3, the two compressor sections 11*a*, 11*b* are connected in series. Working medium compressed in the compressor section 11*a* is further compressed in the compressor section 11*b*. Alternatively, the compressor sections 11*a*, 11*b* can also be connected in parallel, wherein the first line 21 is then connected to the discharge line of one of the two compressor sections 11*a*, 11*b* and also to the return line 27 for the cooling medium to the supply line 14 of one of the two compressor sections 11*a*, 11*b*.

In FIG. 3, the compressor sections 11*a*, 11*b* can each also comprise multiple compressor stages.

In FIG. 3, partially compressed working medium, which was partially compressed by the first compressor section 11*a*, is supplied for further compression to the second compressor section 11*b* via an overflow line 29 and via the first line 21, which branches off from the overflow line 29, also to the ejector 20, so that the ejector 20 again because of the pressure differential between the at least partially compressed working medium and the uncompressed working medium, can suck in uncompressed working medium emanating from the supply line 14 of the turbo-machine arrangement 10 and mix the same with the partially compressed working medium in the region of the mixing chamber 20*a* of the ejector 20. This mixture emanating from the ejector 20 is then again supplied to the electric machine 16 and/or to the at least one other assembly to be cooled such as the bearings 19 for cooling the same. In FIG. 3, the discharge line 15 of the turbo-machine arrangement 10 for the compressed working medium leads away from the second compressor section 11*b*.

Figure 4:
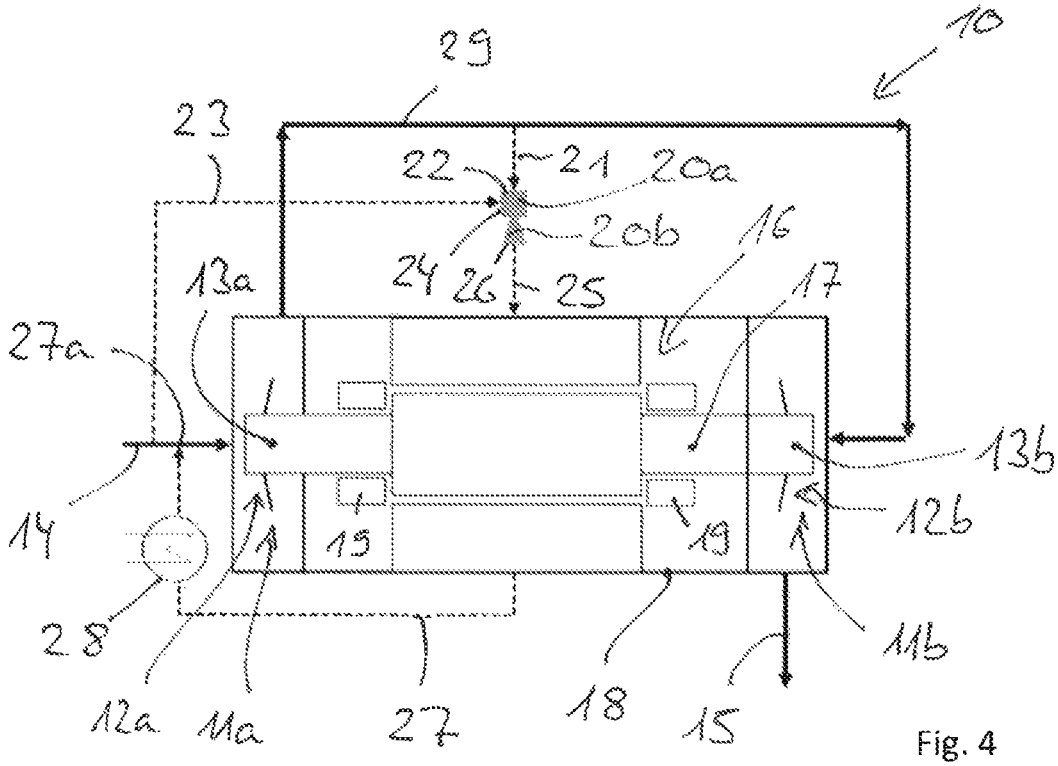
FIG. 4 is a schematised representation of a turbo-machine arrangement.

FIG. 4 shows a modification of the turbo-machine arrangement 10 of FIG. 3 which again differs from the exemplary embodiment of FIG. 3 merely in that a heat exchanger 28 is integrated in the return line 27 for the cooling medium, which returns cooling medium conducted via or through the electric machine 16 in the direction of the supply line 14 of the turbo-machine arrangement 10. Alternatively or additionally, coolers can also be integrated in the lines 21, 23 and 25.

Except for the number and the arrangement of the compressor sections, the exemplary embodiments of FIG. 3, 4 correspond to the exemplary embodiments of FIG. 1, 2, so that for avoiding unnecessary repetitions the same reference numbers are used for same assemblies.

In FIGS. 3 and 4, the compressor sections 11*a*, 11*b* can also be connected in parallel. In this case, the supply line 14 of the turbo-machine arrangement 10 can then lead to both compressor sections 11*a*, 11*b*. With a parallel connection of the compressor sections 11*a*, 11*b*, the first line 21 can be preferentially connected to the discharge line of one of the two compressor sections 11*a*, 11*b* and also at the return line 27 for the cooling medium to the supply line 14 of one of the two compressor sections 11*a*, 11*b*.

Figure 5:
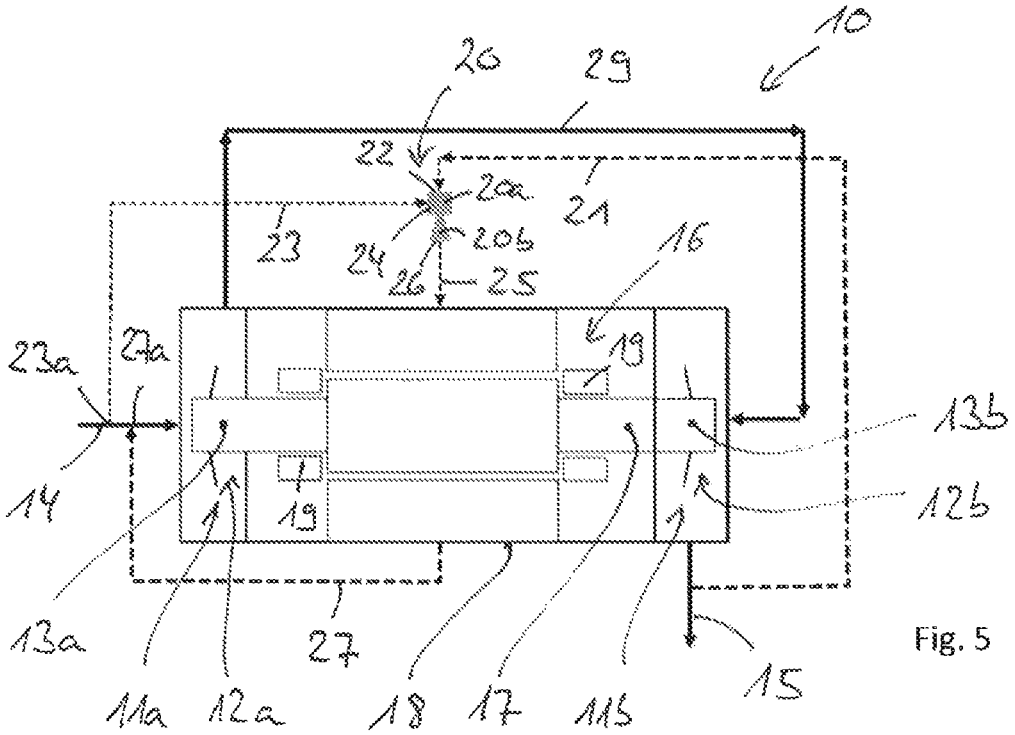
FIG. 5 is a schematised representation of a turbo-machine arrangement.

FIG. 5 shows a modification of the turbo-machine arrangement 10 of FIG. 3 which differs from the turbo-machine arrangement 10 of FIG. 3 in that as propellant, which is supplied to the ejector 20 via the first line 21 or the first connection 22, no partially compressed working medium is utilised in the first compressor section 11*a* but rather completely compressed working medium in the second compressor section 11*b*, so that accordingly in FIG. 5 the first line 21 does not branch off from the overflow line 29, but rather from the discharge line 15 of the turbo-machine arrangement 10. Accordingly, a significantly greater pressure differential between the compressed working medium serving as propellant and the uncompressed working medium sucked in from the supply line is present in FIG. 5, wherein in FIG. 5 the mixture of uncompressed working medium and compressed working medium formed in the ejector 20 preferentially contains a greater portion of uncompressed working medium than in FIG. 3. With respect to all remaining details, the exemplary embodiment of FIG. 5 corresponds to the exemplary embodiment of FIG. 3, so that again for avoiding unnecessary repetitions, same reference numbers are used for same assemblies.

Alternatively, the propellant, with multi-stage compressor design, can also be extracted from an intermediate stage analogously to FIG. 1. Furthermore, the lines 23 and 27 can, instead of at the supply 14 of the turbo-machine arrangement 10, also end at the overflow line 29, so that the cooling medium is only extracted after the compressor section 11*b* and returned into the overflow line 29.

Figure 6:
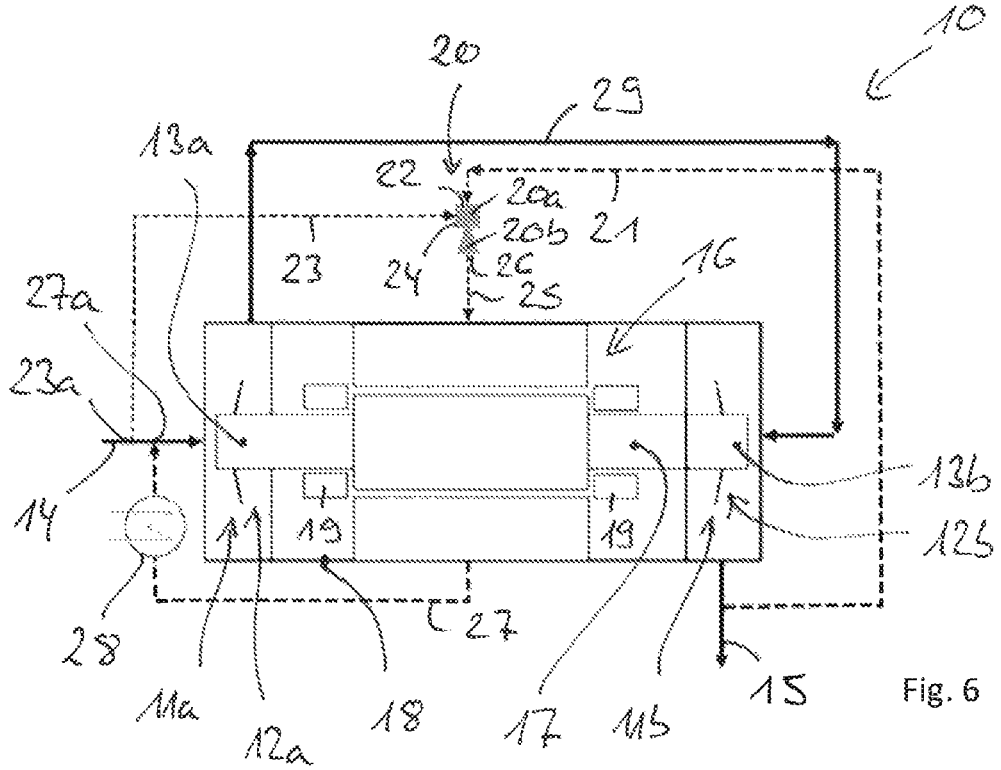
FIG. 6 is a schematised representation of a turbo-machine arrangement.

FIG. 6 shows a modification of the exemplary embodiment of FIG. 5, which again differs from FIG. 5 merely in that the heat exchanger 28 is integrated in the return line 27 of the cooling medium for the cooling medium conducted via or through the electric machine 16 or the at least one other assembly to be cooled such as the bearings 19.

Figure 7:
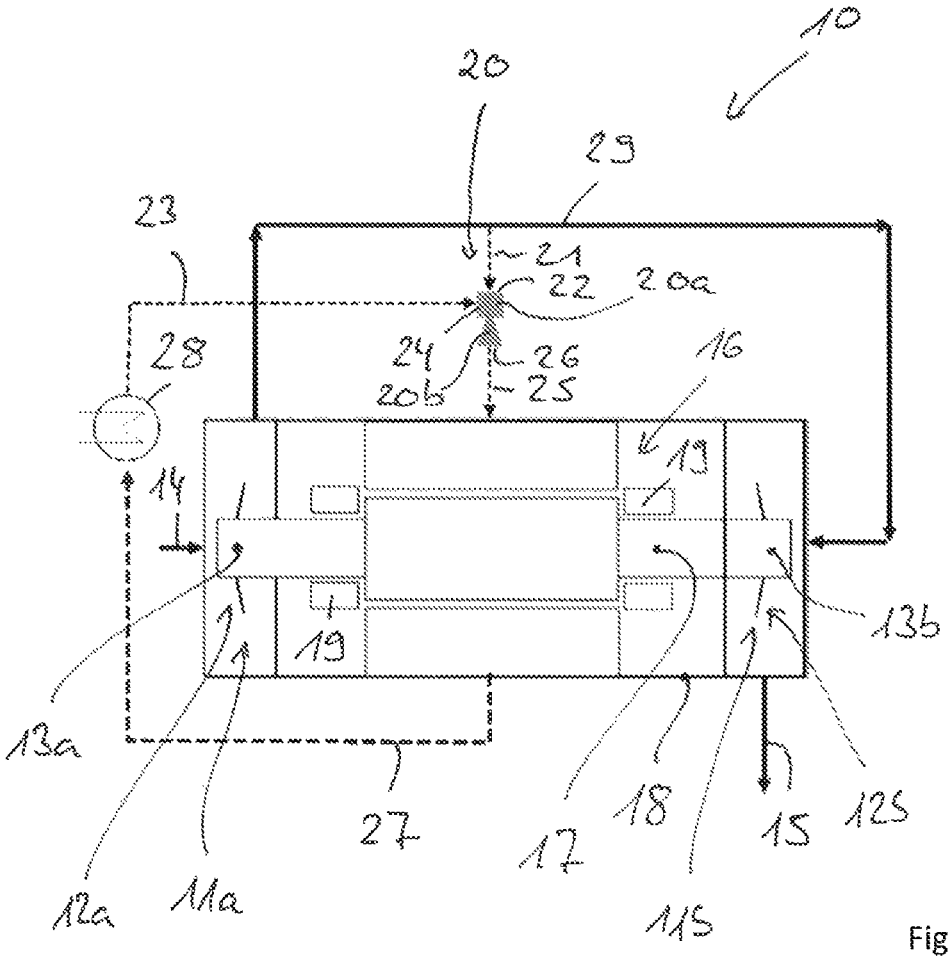
FIG. 7 is a schematised representation of a turbo-machine arrangement.

FIG. 7 shows an embodiment according to one aspect of the invention of a turbo-machine 10, which represents a modification of the turbo-machine arrangement 10 of FIG. 4. While in FIG. 4 the second line 23 branches off from the supply line 14 of the turbo-machine arrangement 10 and the return line 27 of the cooling medium opens into the supply line 14 of the turbo-machine arrangement 10, there is a closed circuit for the cooling medium in FIG. 7, namely in that the second line 23 is coupled to the return line 27 of the cooling medium. Accordingly, working medium partially compressed in the first compressor section 11*a* accordingly serves again as propellant in FIG. 7, which working medium is branched off from the overflow line 29 and via the first line 21 is supplied to the ejector 20, whereas in FIG. 7 no uncompressed working medium is sucked in by the ejector 20, but rather the cooling medium conducted via or through the electric machine 16 and/or the at least one other assembly to be cooled such as the bearings 19, which is discharged via the return line 27 of the cooling medium from the electric machine 16 and/or the at least one other assembly to be cooled such as the bearings 19. Accordingly, the second line 23 and the return line 27 of the cooling medium form a closed cooling circuit for the cooling medium in FIG. 7, in which according to FIG. 7 a heat exchanger 28 is integrated.

In FIG. 7, the ejector 20 can also be supplied via the first line 21 or the first connection 22 with working medium at a first pressure level as propellant, namely for sucking in working medium at a lower second pressure level via the second line 23 or the second connection 24, wherein the mixture formed in the ejector 20 of the working medium at the first pressure level and the working medium at the second pressure level can be supplied as cooling medium to the electric machine 16 and/or to the at least one other assembly to be cooled such as the bearings 19 via the third line 25 or the third connection 26. In FIG. 7, the working medium at the first pressure level is the working medium partially compressed in the compressor section 11*a*, while the working medium at the second pressure level in FIG. 7 is the cooling medium conducted via or through the electric machine 16 and/or the at least one other assembly to be cooled such as the bearings 19, which is supplied via the return line 27 of the cooling medium and the cooler 28 to the second line 23 and thus to the second connection 24. Supplying the propellant via the first line 21 or the first connection 22, offsets any losses of cooling medium in the circuit.

Aspects of the invention allow an efficient cooling of the electric machine 16 and/or of the at least one other assembly to be cooled such as the bearings 19 of a turbo-machine arrangement 10 with a high thermodynamic overall efficiency of the turbo-machine arrangement 10.

The invention makes it possible to employ in turbo-machine arrangements 10 an electric machine 16 with a high power range.

The flow rate through the ejector 20 can be regulated by a preferentially adjustable drive nozzle (not shown). For ensuring a maximum simplicity and robustness of the turbo-machine arrangements 10, however, such a preferentially adjustable drive nozzle can be omitted and the ejector 20 operated in an unregulated state.

In the exemplary embodiments of turbo-machine arrangements 10 shown in FIGS. 1 to 7, the ejector 20 is positioned in each case outside the housing 18, wherein at least some of the lines 21, 25, 29 extend outside of the housing 18 and through the housing 18 at least in portions. Alternatively it is also possible that the ejector 20 is positioned within the housing 18.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A turbo-machine arrangement, comprising:

at least one single or multi-stage compressor section configured to increase a pressure of a working medium, wherein the at least one single or multi-stage compressor section comprises a compressor shaft;

an electric machine having a shaft;

wherein the respective compressor shaft runs coaxially to the shaft of the electric machine;

wherein the respective compressor shaft is coupled to the shaft of the electric machine;

a common hermetically sealed single or multi-part housing in which the electric machine and the at least one single or multi-stage compressor section is are arranged and mounted in the housing via bearings such that the at least one single or multi-stage compressor section, the electric machine, and the bearings are altogether washed about by the working medium;

a supply line configured to supply uncompressed working medium to the turbo-machine arrangement;

a discharge line configured to discharge working medium compressed by the turbo-machine arrangement; and at least one ejector, supplied via a first line or a first connection with working medium at a first pressure level as propellant to draw in working medium at a lower second pressure level via a second line or a second connection, wherein a mixture formed in the at least one ejector of the working medium at the first pressure level and the working medium at the second pressure level is supplied as cooling medium to the electric machine and/or to at least one other assembly to be cooled via a third line or a third connection, wherein the first line or the first connection is arranged directly between the at least one ejector and the common hermetically sealed single or multi-part housing and the third line or the third connection is arranged directly between the at least one ejector and the common hermetically sealed single or multi-part housing.

2. The turbo-machine arrangement according to claim 1, wherein the at least one ejector is supplied via the first line or the first connection with at least partially compressed working medium as propellant for drawing in uncompressed working medium via the second line or the second connection, and wherein the mixture formed in the at least one ejector of the at least partially compressed working medium and of the uncompressed working medium is supplied to the electric machine and/or to the at least one other assembly to be cooled via the third line or the third connection as the cooling medium.

3. The turbo-machine arrangement according to claim 1, wherein the at least one ejector is coupled via the first line or the first connection to:

the compressor section or one of the multi-stage compressor sections or to the discharge line of the turbo-machine arrangement or to a first leakage point of the turbo-machine arrangement.

4. The turbo-machine arrangement according to claim 1, wherein the at least one ejector is coupled via the second line or the second connection to:

the supply line of the turbo-machine arrangement or to the compressor section or one of the multi-stage compressor sections or a second leakage point of the turbo-machine arrangement or a return line of the turbo-machine arrangement for the cooling medium conducted via or through the electric machine and/or the at least one other assembly to be cooled.

5. The turbo-machine arrangement according to claim 1, wherein the at least one ejector is coupled via the third line or the third connection to the electric machine and/or to the at least one other assembly to be cooled.

6. The turbo-machine arrangement according to claim 1, wherein a return line for the cooling medium conducted via or through the electric machine and/or the at least one other assembly to be cooled is coupled to the second line leading to the at least one ejector or the second connection of the at least one ejector.

7. The turbo-machine arrangement according to claim 1, wherein a single compressor section having at least one compressor stage is arranged on a side of the electric machine coaxially to the same.

8. The turbo-machine arrangement according to claim 1, wherein two compressor sections each with at least one compressor stage which, on sides of the electric machine located opposite one another, are each arranged co-axially to the same.

9. A turbo-machine arrangement, comprising:

at least one single or multi-stage compressor section configured to increase a pressure of a working medium, wherein the at least one single or multi-stage compressor section comprises a compressor shaft;

an electric machine having a shaft;

wherein the respective compressor shaft runs coaxially to the shaft of the electric machine;

wherein the respective compressor shaft is coupled to the shaft of the electric machine;

a common hermetically sealed single or multi-part housing in which the electric machine and the at least one single or multi-stage compressor section is arranged and mounted in the housing via bearings such that the at least one single or multi-stage compressor section, the electric machine, and the bearings are altogether washed about by the working medium;

a supply line configured to supply uncompressed working medium to the turbo-machine arrangement;

a discharge line configured to discharge working medium compressed by the turbo-machine arrangement; and at least one ejector, supplied via a first line or a first connection with working medium at a first pressure level as propellant to draw in working medium at a lower second pressure level via a second line or a second connection, wherein a mixture formed in the at least one ejector of the working medium at the first pressure level and the working medium at the second pressure level is supplied as cooling medium to the electric machine and/or to at least one other assembly to be cooled via a third line or a third connection, wherein a return line for the cooling medium conducted via or through the electric machine and/or the at least one other assembly to be cooled is coupled to the supply line of the turbo-machine arrangement such that an opening point of the return line of the cooling medium into the supply line of the turbo-machine arrangement, seen in a through-flow direction of the supply line, lies downstream of a branch-off point of the second line or of the second connection of the supply line of the turbo-machine arrangement.

10. The turbo-machine arrangement according to claim 9, wherein a heat exchanger or cooler is integrated in the return line.

* * * * *